US007167416B2

(12) United States Patent
Krishnamani

(10) Patent No.: US 7,167,416 B2
(45) Date of Patent: Jan. 23, 2007

(54) MECHANICAL WATCH EQUIPPED WITH WEEKLY CYCLE INDICATOR

(76) Inventor: Asthagiri Raman Krishnamani, Rouges-Terres 11A, 2068 Hauterive (CH)

( * ) Notice: Subject to any disclaimer, the term of this patent is extended or adjusted under 35 U.S.C. 154(b) by 129 days.

(21) Appl. No.: 10/469,324

(22) PCT Filed: Mar. 6, 2002

(86) PCT No.: PCT/CH02/00135

§ 371 (c)(1),
(2), (4) Date: Dec. 24, 2003

(87) PCT Pub. No.: WO02/071339

PCT Pub. Date: Sep. 12, 2002

(65) Prior Publication Data

US 2004/0081026 A1 Apr. 29, 2004

(30) Foreign Application Priority Data

Mar. 8, 2001 (EP) ..... 01810237

(51) Int. Cl.
*G04B 19/24* (2006.01)
*G04F 8/00* (2006.01)
*G04F 10/00* (2006.01)

(52) U.S. Cl. ..... 368/28; 368/110

(58) Field of Classification Search ..... 368/108, 368/107, 110–113, 28, 32, 97, 223, 224, 225, 368/228, 232, 294, 295
See application file for complete search history.

(56) References Cited

U.S. PATENT DOCUMENTS

| | | | | | |
|---|---|---|---|---|---|
| 1,367,403 | A | | 2/1921 | Lesher | |
| 1,455,482 | A | * | 5/1923 | Gleason | 368/223 |
| 3,628,322 | A | * | 12/1971 | McDuffee et al. | 368/28 |
| 3,719,037 | A | | 3/1973 | Williams | 58/74 |
| 3,958,529 | A | | 5/1976 | Morris | 116/113 |
| 3,974,362 | A | * | 8/1976 | Willmann et al. | 377/20 |
| 4,063,071 | A | * | 12/1977 | Willmann et al. | 377/20 |
| 4,340,808 | A | * | 7/1982 | Donohoo | 377/13 |
| 4,972,393 | A | * | 11/1990 | Sase et al. | 368/28 |
| 5,793,708 | A | * | 8/1998 | Schmidt et al. | 368/106 |
| 6,088,303 | A | * | 7/2000 | Oishi | 368/41 |
| 6,359,840 | B1 | * | 3/2002 | Evans | 368/80 |
| 6,388,952 | B1 | * | 5/2002 | Kim | 368/74 |
| 6,826,122 | B1 | * | 11/2004 | Zaugg | 368/28 |

* cited by examiner

*Primary Examiner*—Judy Nguyen
*Assistant Examiner*—Leo T. Hinze
(74) *Attorney, Agent, or Firm*—Hugh R. Kress; Browning Bushman P.C.

(57) ABSTRACT

The invention relates to a watch comprising a movement arranged for driving hands displaying hours and minutes as well as a counting mechanism for driving an additional hand arranged to display the working time of the watch user, day after day, within a one week cycle.

8 Claims, 5 Drawing Sheets

MECHANICAL WATCH EQUIPPED WITH WEEKLY CYCLE INDICATOR

Present application is the national stage of PCT application No PCT/CH02/00135 filed on Mar. 6, 2002 and claiming Priority of European Patent Application No 01810237.6 of Mar. 8, 2001.

TECHNICAL FIELD

The present invention relates to the mechanical or electromechanical watch field.

BACKGROUND ART

Various development projects have examined ways of tracking working time in companies. The most familiar example is the clock card system which enable employees to clock in when they reach work, and to clock out when they leave. A timepiece of this kind, commonly known as the clock card unit, provides a clear documentary record that each employee has clocked up the correct number of contracted hours of work.

Self evidently, information obtained in this manner is confidential in nature. Employees only have access to information relating to their own arrival and departure times. At these times of day, no great analysis of information is really possible because several people are usually arriving or leaving at once, making it difficult for an employee to study at any length precisely how long he or she has spent at work.

There are also devices which make it possible to determine the time required to perform a specific task. A knowledge of these times makes it easier to raise invoices for work completed. One of these devices is described in document U.S. Pat. No. 3,719,037. This device features an hour and a minute hand and can record times extending up to a half-day of work. A pushbutton can be used to check arrival/departure times and intermediate breaks.

While a solution of this kind is well suited to the task of measuring working time spent on a specific task, it is not suitable for enabling employees to identify to any satisfactory extent the time they have actually been working for their employer.

SUMMARY OF THE INVENTION

The purpose of this invention is to propose a mechanical or electromechanical watch which provides a good overview of working time recorded over a period of one week. Many people would appreciate a record of timekeeping of this kind since it would better enable them to plan and organize their work schedule.

To be more specific, the watch described in this invention is a model comprising, in classical manner, a casing which in turn contains the following components:

- a movement featuring a time base, a set of wheels driven by the time base and a manual means of correction which provides access to the gear train and
- a facility for recording time comprising a dial and at least two hands driven by the wheels and moving across the dial to show the time in hours and minutes.

The watch described above also features:

- A facility for counting hours
- Additional display facilities linked to the hour-counting unit to display the contents and operations involved in completing a cycle within one week and

- A clutch whose function is to activate the counting mechanism by connecting them to the gear train.

In a favourable embodiment, this gear train comprises:

- A first moving part which performs a complete revolution in multiples of one week and equipped with a first mechanical component capable of defining days of the week during which the counting mechanism should be activated and
- A second moving part which performs one revolution every 24 hours and which is equipped with a second mechanical component capable of defining the hours between which the counting mechanism should be activated.
- The aforementioned clutch unit can be controlled by means of two mechanical components to activate the aforementioned counting mechanism for counting the desired days and hours.

In a preferred embodiment, in this implementation form, the mechanical components take the form of cams.

In another preferred embodiment, the watch can also feature manual control facilities which can be used to act on the second mechanical component in order to define the hours during which the counting mechanism should be activated.

In accordance with another favourable embodiment, the watch also comprises manual control facilities which can be used to operate the clutch which can then in turn, at its own convenience, operate the counting mechanism. In this embodiment, the time counting facilities comprise a moving part which can be linked to the gear train by the clutch, complementary display facilities comprising a unit which records working time completed, the aforementioned moving part and the aforementioned manual control facilities which comprise a first and second pushbutton fitted to the case and arranged in the way which enables them to interact with the counting facilities which are in turn arranged in such a way that pressure on the second pushbutton applied when the working time is completed resets the unit to zero.

Furthermore, and in a particularly advantageous manner, these additional display facilities also include:

- an indicator of outstanding working time (time owing) which can be controlled by means of the aforementioned correctional facilities
- an indicator of time reported (time worked) which is controlled by the action of the aforementioned second pushbutton,
- whose methods of counting time are initiated in response to pressure being exerted on the second pushbutton while the time indicator is stopped, causing the indicator for time worked to move to an angle relative to indicator for time owing which shows the difference between these two parameters.

BRIEF DESCRIPTION OF THE DRAWINGS

Other advantages and characteristics of this invention will emerge from the description which follows, based on the drawing illustrated in the annex and in which.

DETAILED DESCRIPTION OF PREFERRED EMBODIMENTS

Figure 1:
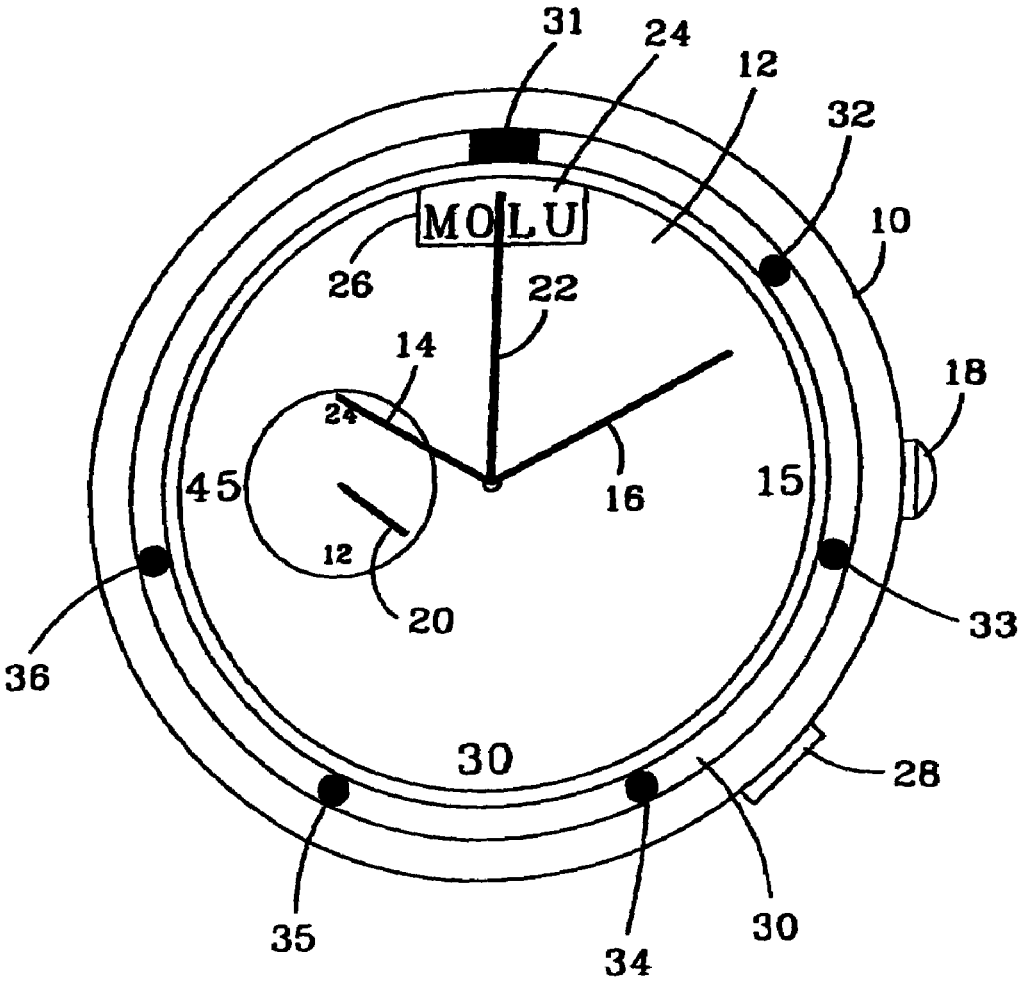
FIGS. 1 and 2 respectively illustrate the means of display and the mechanism of a mechanical watch in an initial form of implementation

In this description, the position of components on the watch and in the movement is defined with reference to the classical position occupied by the hour hand, located in the centre of the dial and completing two full revolutions every 24 hour period.

The watch illustrated in FIG. 1 comprises a case 10 and, located within it, a mechanical movement which will be described with reference to FIG. 2, a dial 12, an hour hand 14 and a minute hand 16. A crown 18 shown at 3 o'clock makes it possible for the components of the movement to be driven and can facilitate re-assembly of the movement.

The watch in FIG. 1 also comprises a "24 hour" hand 20, arranged at 9 o'clock and executing 1 complete revolution per 24 hour period, an additional hand 22 indicating time worked, coaxial to hands 14 and 16 and an indicator disc for days of the week 24 displayed in an aperture 26 located at midday on dial 12. A pushbutton 28, located at 4 o'clock, is used to guide hand 22 in the manner described later.

Case 10 is equipped with a groove 30 machined into its outer edge and encircling the dial 12. Indexes 31 to 36 are fitted in this groove. Index 31 is static, set at midday, while the others, five in number, can friction-slide in the groove. They can be used to form an adjustable scale relative to hand 22 with index 31 providing a datum point and indexes 32 to 36 each marking the end of one day of work.

Displaying information using hands 14, 16 and 20 and the 24 hour this is all performed in classical manner and requires no special comment.

Hand 22 is only driven by the movement during working hours. The mechanism which provides this drive function is illustrated on FIG. 2, viewed facing the dial.

The movement features a plate 37 which provides support for different moving part components, primarily disc 24. At the edge of this plate, illustrated in schematic manner, are crown 18 and pushbutton 28.

Figure 2:
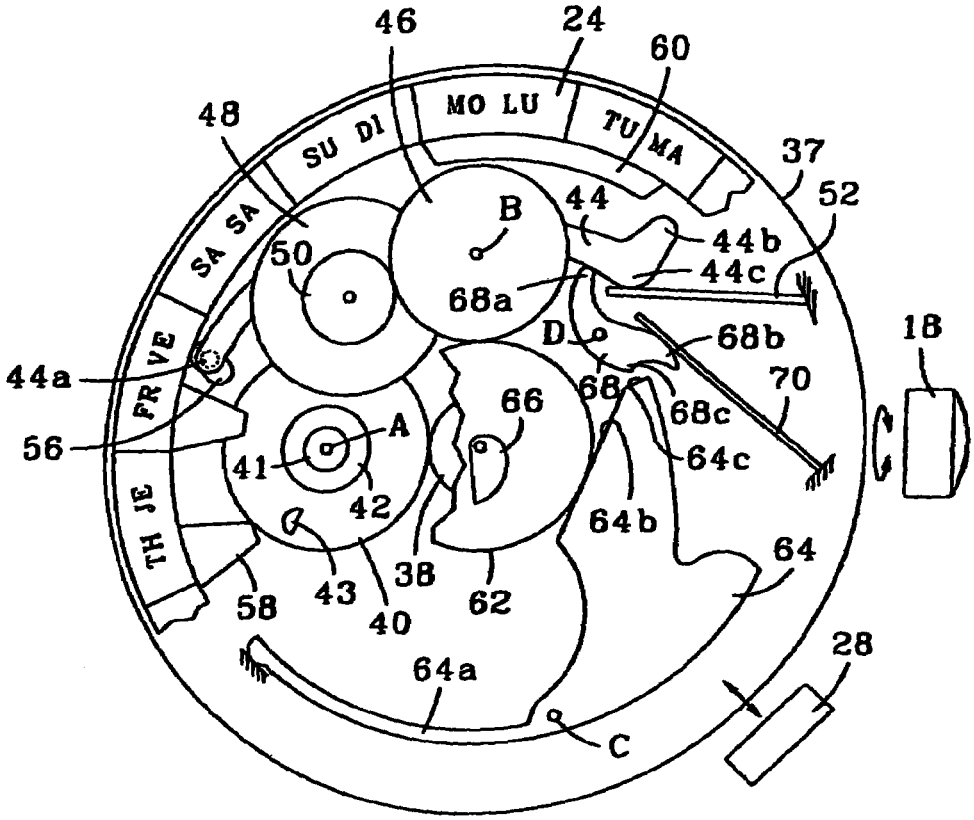

Plate 37, on the opposite side to the one shown on FIG. 2 and therefore not visible on the drawing, supports a barrel which acts as a power source, a going-train driven by the barrel and on which one moving part, the centre wheel, supports a cannon-pinion on which the minute hand 16 is located, an escapement controlled by the going-train and a balance wheel powered by the escapement and whose oscillations define the operation of the watch.

Plate 37, on the face illustrated in FIG. 2, supports a dial-train and time-setting which has also not been illustrated and which is driven by the cannon-pinion. This train comprises a cannon wheel which performs one revolution every twelve hours, supports hand 14 and is equipped with a pinion 38. A 24-hour wheel 40 meshes with pinion 38. It pivots around an axis A which is perpendicular to plate 37 and which is arranged at 9 o'clock. The 24 hour hand 20 is secured to this wheel. Pinion 38 and wheel 40 have a tooth meshing ratio of 1:2 which enables wheel 40 to complete one revolution per 24-hour period in an anti-clockwise direction.

Wheel 40 comprises a central shaft 41 and supports a coaxial pinion 42 and a drive finger 43 arranged at its edge, the functions of which will be described in more detail later on.

A lever 44 intended to control the mechanism which drives, or does not drive, the hand showing working time completed 22 and is mounted with pivot action around axis B, perpendicular to plate 37 and arranged at midday position. It comprises two fingers 44*a* and 44*b* and a boss 44*c* for which the functions will be described at a later point. Furthermore, it supports two wheels 46 and 48 as well as a pinion 50 which forms an integral part of wheel 48.

Wheel 46 is mounted in mobile fashion, and can rotate around axis B. It meshes with pinion 50. Wheel 48 is arranged in a manner which, depending on the position of lever 44, enables it to mesh or not with pinion 42. Lever 44 therefore provides a good clutch function since wheel 48 is only driven when it is meshing with pinion 42.

A spring 52, an integral part of plate 37, is supported against boss 44*c*, therefore giving rise to a torque which causes lever 44 to pivot in an anti-clockwise direction.

Shaft 41 traverses plate 37 and supports, on the opposite side, a cam 54 which is intended to connect with finger 44*a* which itself traverses plate 37 via an aperture 56.

Figure 2A:
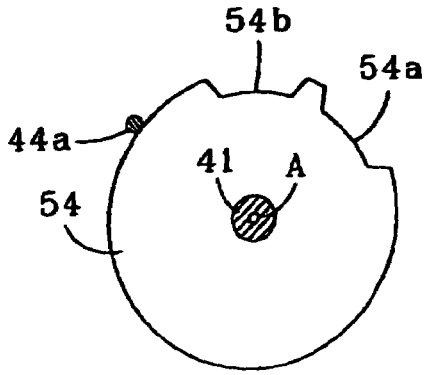

Cam 54, illustrated on FIG. 2*a*, comprises two apertures 54*a* and 54*b*, each of which extends across an angle of 60°, an angle travelled in a 4 hour period starting from the point where wheel 40 completes one full revolution of the 24 hour period. Cam 54 is arranged in such a way that finger 44*a* engages in apertures 54*a* and 54*b* during working hours which extend from 8 am to mid-day, then from 1 pm to 5 pm. When finger 44*a* is engaged in one of the apertures 54*a* and 54*b*, spring 52 then guides lever 44 into a position where wheel 48 is meshing with pinion 42.

The disc, which is in fact a ring 24, bears two sets of the days of the week around its edge on the face adjacent to dial 12. This disc is equipped with fourteen teeth 58 of which only two are visible on the drawing and which extend in a radial direction into the central aperture of the ring, intended to connect with the drive finger 43. It also comprises two annular sectors 60 of which only one is visible on the drawing, extending in a radial direction towards the interior of the unit and arranged at the same height as finger 44*b* in such a way that the finger can obtain support from it whenever the days "Saturday" and "Sunday" appear in aperture 26. In this manner, for this two day period, lever 44 inhibits the clutch action which enables wheel 48 to mesh with pinion 42.

The movement comprises, in its centre, a wheel 62 which indicates working time, arranged above a cannon wheel and supporting hand 22. Wheel 62 meshes with wheel 46 supported by lever 44. This means that, when finger 44*a* enters one of the grooves 54*a* or 54*b* in cam 54, it follows that sectors 60 are not aligned with finger 44*b* and that wheel 62 is linked kinematically to wheel 40 and therefore rotates in a clockwise direction. The number of teeth provided on pinions 42 and 50 and on wheels 46, 48 and 62 has been chosen with a view to the last of these wheels covering an angle of 6° per hour, equivalent to one complete revolution every 60 hours.

In most cases, the working time owed by an employee is less than 60 hours. This is why it has to be possible to reset hand 22 to zero at the end of each working week. This function is provided by pushbutton 28 and by a mechanism comprising a hammer 64 and a snail type of cam 66, mounted on wheel 62.

Hammer 64 pivots on plate 37 around an axis C arranged at 6 o'clock. It comprises a flexible arm 64*a*, the end of which is supported against plate 37, generating a torque which tends to rotate the arm in a clockwise direction and thus to hold it against pushbutton 28. Hammer 64 also comprises a support surface 64*b* which is arranged facing cam 66 in such a way that it is supported against the cam whenever pushbutton 28 is pressed. To be more precise, hammer 64 causes cam 66 to rotate, entraining wheel 62 and hand 22 up to the point where the hand reaches the 12 o'clock position. Finally, hammer 64 forms a limit stop 64*c* adjacent to support surface 64*b* which has the function of preventing an untimely reset to zero, something which will be explained more fully at a later point.

It is evident that hand 22 can only be reset to zero at the end of a working week once lever 44 is disengaged. At this point, only wheels 46 and 48 and pinion 50 rotate together with wheel 62. If this were not the case, the entire dial-train could be entrained which would alter the time actually displayed.

To avoid any untimely manipulation, the movement comprises a bolt 68 and a spring 70 arranged in the space between the hammer 64 and the lever 44. Pin 68 pivots around an axis D. It comprises finger 68*a* and a boss 68*b* against which spring 70 applies pressure, creating a torque which holds finger 68*a* against lever 64. Bolt 68 is arranged in such a way that a portion 68*c* forms a spring-catch and may or may not be located in the space swept by hammer 64 depending on whether or not lever 44 performs the function of a clutch. It follows from this that it is not possible to apply hammer 64 to cam 66 when wheel 62 is being driven.

In the aforementioned example, working time is envisaged as 8 to 12 am, then 1 to 5 pm. Needless to say, working hours can vary significantly from one company to another, and from one country to another. For this reason, cam 54 is arranged on the opposite side of the movement to dial 12. It is therefore possible to replace it with a different one which more accurately reflects the working hours in force. These cams are easy to manufacture using a milling process and an ad hoc jig or fixture. They can then be installed by any trained watchmaker.

The mechanism described with reference to FIGS. 1 and 2 is well suited to people working to a regular timetable. On the other hand, it is of little interest to companies operating with flexible working hours. The watch illustrated in FIGS. 3 to 5 offers the wearer a means of tracking his programme of work.

Figure 3:
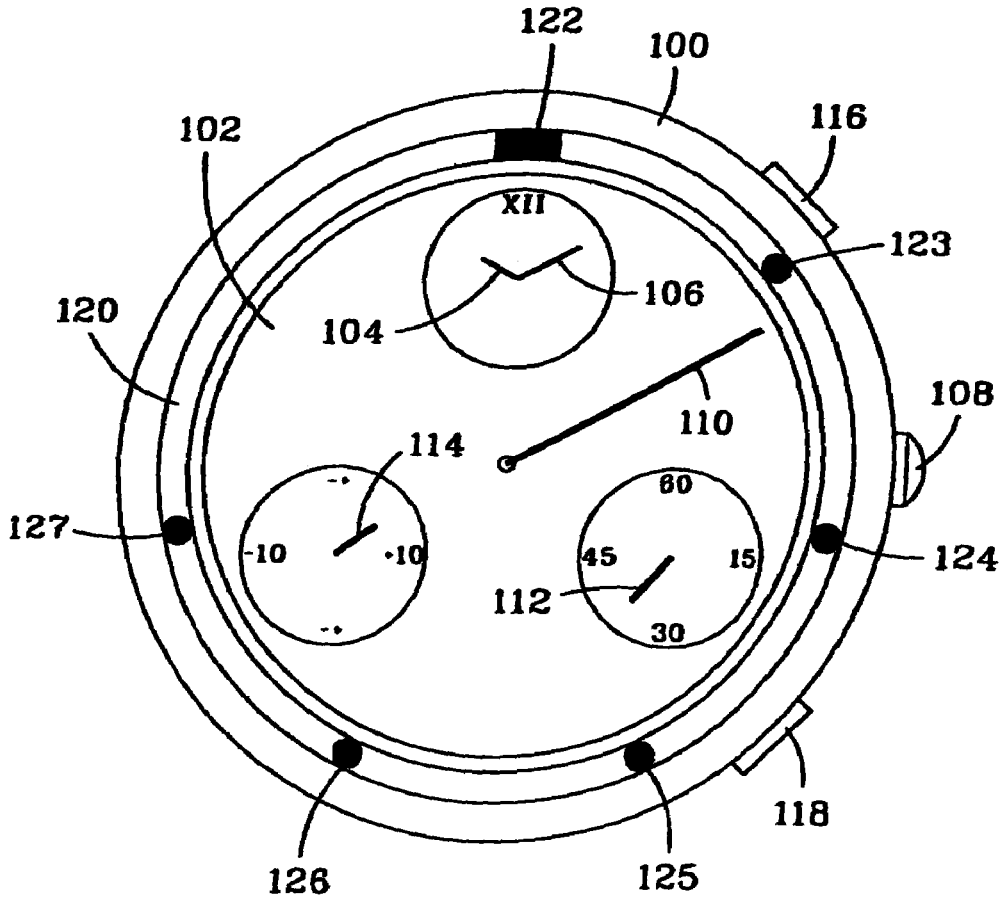
FIG. 3 illustrates the means of display of a mechanical watch in accordance with a second form of implementation

FIG. 3 illustrates this watch as it is seen by the wearer. It comprises a case 100 forming a housing in which a movement is located which is not visible in this figure and which will be described partially, with reference to FIGS. 4 and 5. It also comprises a dial 102 arranged on the movement, an hour hand 104 and minute hand 106 which are both mounted coaxially on the movement and pivoting around an axis arranged at mid-day in the central section of dial 102. The movement is controlled by a winding and time-setting crown 108 on which an arbor is located, visible on this drawing, which traverses the case 100 and drives the components of the movement.

The indications relating to working time are displayed by means of three hands known respectively as the "time worked" hand 110, the "official working time" hand 112 and the "time reported" hand 114. To be more precise, hand 110 which pivots around the centre of the movement displays the length of time worked during the current week. Hand 112, situated at 4 o'clock, indicates the average weekly working time due by the employee to his/her employer while hand 114, situated at 8 o'clock, displays the cumulative positive or negative variance between time worked each week and working time due.

Case 100 also features two pushbuttons 116 and 118, situated respectively at 2 o'clock, for starting and stopping the time counting function, and at 4 o'clock for zeroising the counter.

In a similar manner to FIGS. 1 and 2, case 100 incorporates the advantage of a groove 120 in which six indexes 122 to 127 are housed, whereby index 122 is fixed in position and 123 to 127 are able to move.

The movement of this watch also comprises, in classical manner and not shown on this drawing, a barrel which delivers motive power, a going-train which drives an escapement which operates a balance and which in turn defines the operation of the watch.

Figure 4:
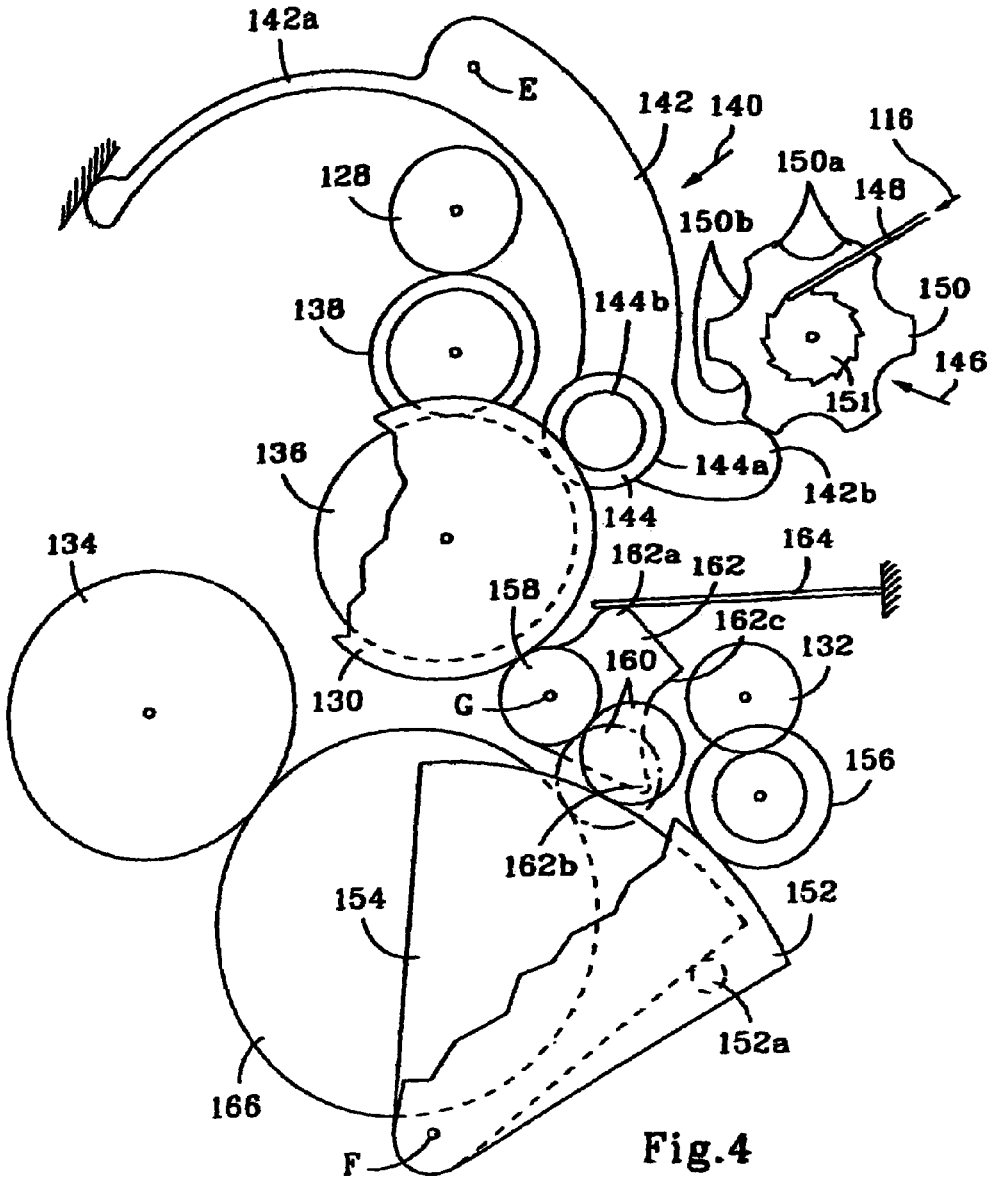
FIGS. 4 and 5 illustrate the control mechanism for the form of implementation shown in FIG. 3.
Figure 5:
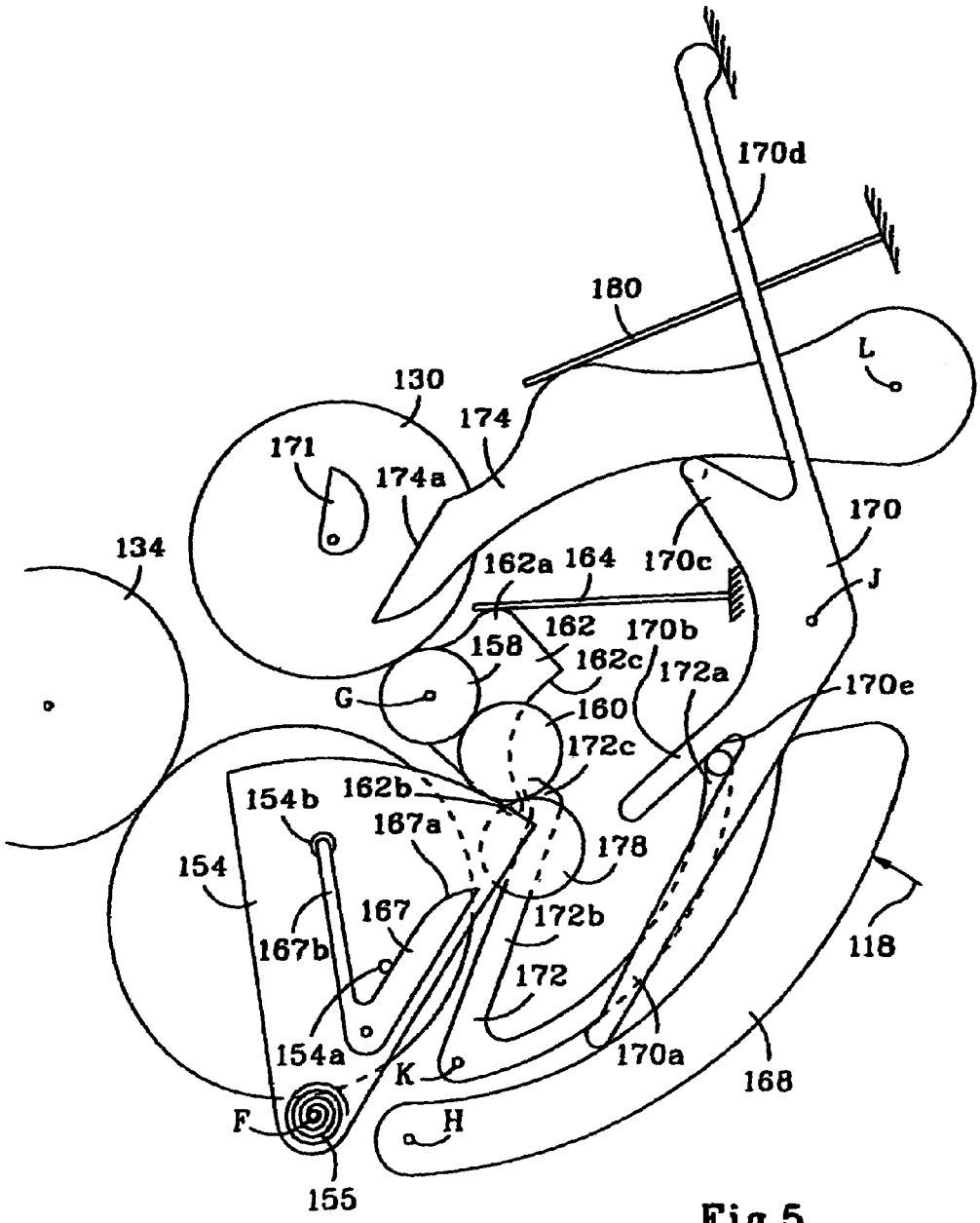

The specific mechanism used to control hands 110, 112 and 114 is illustrated on FIGS. 4 and 5. FIG. 4 illustrates more clearly the components associated with commands issued using pushbutton 116 whereas FIG. 5 refers to the components activated when pushbutton 118 is pressed. These figures only illustrate the moving parts. It goes without saying that these are arranged on a support, for example a plate, in the manner previously described with reference to FIGS. 1 and 2.

In keeping with the watch illustrated in FIG. 4, the mechanism comprises four moving parts with references 128, 130, 132 and 134 on which, respectively, the hour hand 104, the hand showing time worked 110, the hand showing time owed 112 and the hand showing reported time 114 are situated.

Wheel 128 is driven by the going-train and completes one revolution every twelve hours. It meshes with a central wheel 136, coaxial to wheel 130 and acting via an intermediate wheel 138. The central wheel 136 therefore rotates continuously. A clutch 140 provides a kinematic link between wheels 138 and 130. This comprises a lever 142, pivoting around axis E and equipped with a flexible arm 142*a* and a boss 142*b*. It bears a moving part 144 formed by a wheel 144*a* and a pinion 144*b*, superimposed and arranged respectively at the same height as wheels 136 and 130.

By means of boss 142*b*, lever 142 interacts with a cam 146 which is driven by pushbutton 116, schematically represented by an arrow which controls pawl 148. Cam 146 comprises, in a superimposed manner, a cross 150 with six branches 150*a* separated by the same number of round recesses) 150*b* with a complementary shape to that of boss 142*b* and a pawl wheel 151 comprising twelve teeth. The cross 150 is located on the same plane as lever 142 whereby boss 144*b* is supported on one of the branches in one of the recess. Furthermore, wheel 151 interacts with a retaining pawl not shown on this drawing and which prevents cam 146 from retracting when pawl 148 moves back into position.

Every time pushbutton 116 is pressed, cam 146 rotates through 30°, causing boss 142*b* to pass from a recess to a following branch and vice versa. Lever 142 is therefore arranged in such a way that moving part 144 meshes with wheels 130 and 136 whenever boss 142*b* is supported against one of the branches 150*a*, thus ensuring that the clutch functions or, alternatively, when it is away from these wheels, that boss 142*b* is supported against one of the recesses 150*b* in such a way that they mutually oppose any clutch action which might affect them. In other words, all the user has to do is to press pushbutton 116 to initiate the function which counts working time, then to press it again to stop the function.

Regulation of the position of hand 112, indicating working time owed, is performed using the crown 108 and a mechanism similar to the one illustrated in FIG. 2, not shown on the drawing, to avoid overloading the unit.

Hand 112 is driven when crown 108 is pulled out to its first stop, said drive being provided by wheel 132. To benefit from this information in meaningful manner, it has to be compared with the time actually worked, said function being delivered by two superimposed toothed sectors 152 and 154 which pivot around a common axis F and which are interconnected by means of a spiral spring 155 schematically illustrated on FIG. 5, interposed between them and secured to each sector at either end.

Sector 152 is linked to wheel 132 by a moving part 156 and is fitted with a pin 152*a* which forms a limit stop and is intended to interact with sector 154, where the latter is supported against pin 152*a* in the absence of any external constraint. Sector 154 is linked to wheel 130 by two intermediate wheels 158 and 160 mounted on lever 162 whose function will be described in detail at a later point and which is itself pivot-mounted on axis G, which can be mistaken for the axis of rotation of intermediate wheel 158. Lever 162 comprises a boss 162*a* which interacts with a spring 164 which develops a torque capable of retaining intermediate wheel 160 in mesh with sector 154. It also comprises a finger 162*b* and a support surface 162*c* for which the functions will be described later with reference to FIG. 5.

When the counting operation starts, hand 110 is at midday and sector 154 is supported against pin 152*a*. When the user presses pushbutton 116, clutch 140 interconnects wheels 130 and 136 in such a way that wheel 130 starts to rotate in a clockwise direction. This wheel drives the intermediate wheels 158 and 160 as well as sector 154 which rotates around axis F in an anti-clockwise direction. The active length of sector 154 is defined by the position of pin 152*a* or, in other words, of hand 112.

Throughout the course of the week, the user can stop and start the working time counting function by pressing pushbutton 116. Once the total of time worked exceeds the working time owed, hand 114 has to be driven in a clockwise direction of rotation. This drive action is performed by means of a intermediate wheel 166 which is in mesh with wheel 134. To be more precise, once sector 154 has covered the angle corresponding to the working time owed, intermediate wheel 160 is no longer held by sector 154 which means that lever 162 pivots in response to spring 164 until intermediate wheel 160 meshes with intermediate wheel 166 as illustrated with the line of dashes on FIG. 4. From this time, wheel 134 is connected kinematically to wheel 130 and rotates in a clockwise direction until the pushbutton 116 is pressed again, at which point wheel 130 is disconnected.

At the end of the working week, hand 110 must be reset to zero after first recording the difference between time worked and time owed as shown by hand 114. This function is performed by the components of the mechanism illustrated in FIG. 5.

More specifically, this figure illustrates wheels 130 and 134, sector 154, intermediate wheels 158, 160 and 166, lever 162 with its finger 162*b* and its support surface 162*c* as well as spring 164. Pushbutton 118 is schematically illustrated in the form of an arrow. A pawl 167 formed by a rigid arm 167*a* and a flexible arm 167*b* is pivot-mounted on sector 154 with rigid arm 167*a* extending into the section between the tip of pivot unit F and the edge section equipped with teeth, with pin 152*a* supported down the length of its flank. A pin 154*a* is secured to sector 154 in a position reaching to rigid arm 167*a*. Sector 154 is equipped with a recess 154*b* in which the extreme end of the flexible arm 167*b* locates, arranged in such a way that the flexible arm delivers a torque which holds the rigid arm against pin 154*a*.

The mechanism also comprises three levers 168, 170 and 172, a hammer 174 and a cam 176 which forms part of a shaft supporting hand 110 and friction-mounted on wheel 130. Lever 168 makes it possible to amplify the movement of pushbutton 118. This pivots around 13 an axis H adjacent to the 6 o'clock position and supported half-way down against lever 170 between the fulcrum of the lever and the support point of pushbutton 118.

Lever 170 is mounted in pivot fashion around an axis J which is arranged near the 3 o'clock position. It comprises three control fingers 170*a*, 170*b* and 170*c*, arranged to interact respectively with sector 154, lever 162, hammer 174, a flexible arm 170*d* supported against the plate at 1 o'clock and delivering a torque capable of pressing levers 168 and 170 together.

To be more precise, the end of finger 170*a* is arranged in such a way that it is supported against rigid arm 167*a* on pawl 167, thereby also driving sector 154 up to the point where it ceases to be in mesh with intermediate wheel 160.

The tip of finger 170*b* is arranged in such a way that it can interact with support surface 162*c*, thereby causing lever 162 to pivot in an anti-clockwise direction, causing intermediate wheel 160 to disengage from sector 154.

The tip of finger 170*c* is supported against one flank of hammer 174 in such a way that the latter moves into contact with cam 176, thus ensuring that hand 110 is reset to zero, as will be explained at a later point in the text.

Fingers 170*a* and 170*b* form a recess 170*e* for which the function will be described at a later point.

Lever 172 pivots on axis K arranged sensibly at 5 o'clock between the centre of the movement and lever 168. It comprises a flexible arm 172*a* the end of which engages in the recess 170*e* in such a way that it is driven whenever lever 170 pivots, a rigid arm 172*b* supporting intermediate wheel 178 with finger 172*c* at one end which is there to interact with finger 162*b* to hold lever 162 in position.

Hammer 174 is pivot-mounted on axis L, arranged between 2 and 3 o'clock. It extends towards the centre of the movement, pointing towards cam 176 and is arranged in such a way that, when lever 170 makes contact with its flank, it pivots clockwise. Hammer 174 comprises an extremely smooth working surface 174*a* which makes contact with finger 176 and develops a torque capable of rotating the shaft until the point where hand 110 points to 12 o'clock.

A spring 180, which forms part of the plate, applies force to hammer 174 on the opposite side to finger 170*c* and develops a torque which guides hammer 174 anti-clockwise until it reaches a rest position.

When, at the end of the week, the user wishes to reset hand 110 to zero, he simply presses down on pushbutton 118. Two situations can arise at this point.

In the first of these, which is not illustrated, effective working time is greater than working time owed. This means that sector 154 is no longer driven by intermediate wheel 160 and is instead in mesh with intermediate wheel 166. Whenever the user presses pushbutton 118, he entrains levers 168, 170 and 172.

Lever 172 then holds lever 162 in the position it occupies using finger 172*c* to do so. At the same time, intermediate wheel 178 is in mesh with intermediate wheels 160 and 166. Since the latter is also in mesh with intermediate wheel 166, the three intermediate wheels provide reciprocal locking action which is also applied to the gear train which extends up to wheel 130.

Finger 170*a* moves in to support arm 167*a* on pawl 167. It pushes away sector 154 in a clockwise direction until the end of finger 170*a* moves beyond the end of arm 167*a*. Sector 154 is then no longer held in place and it drops down against intermediate wheel 160. Lever 170 continues to move until finger 170*b* comes into contact with support surface 162*c*. This causes lever 162 to pivot clockwise, releasing sector 154 which returns to its initial position, supported against pin 152*a*.

Incidentally, finger 170*c* acts on hammer 174 which causes cam 176 to rotate and, with it, the shaft on which hand 110 is mounted.

Whenever the user release pushbutton 118, the flexible arm 170*d* returns the lever to its initial position and at the same time drives levers 168 and 172. During this movement, pawl 167 retracts to allow finger 170*a* to pass.

The second situation arises when time worked is less than working time owed. In this instance, intermediate wheel 160 remains in mesh with sector 154. Whenever pressure is applied to pushbutton 118, lever 168 pivots and at the same time drives levers 170 and 172. Lever 172 moves intermediate wheel 178 into mesh with intermediate wheels 160 and 166, then flexible arm 172*a* alters shape to keep the intermediate wheel in this position. After this, finger 170*a* pushes against pawl 167 which in turn drives sector 154 which in turn drives intermediate wheels 160, 178 and 166 which in turn drives wheel 134 in an anti-clockwise direction. This is another way of saying that the mechanism is capable of maintaining a negative count of the difference between working time owed and actual time worked. Whenever sector 154 reaches the position in which intermediate wheel 160 ceases to be driven, the same conditions as those encountered at the end of the first situation enter into force.

The mechanism described in FIGS. 3 to 5 can be beneficially supplemented by functions such as locking of pushbutton 118 whenever clutch 140 is in mesh with wheels 130 and 136 or during the zeroising of hand 114. Friction-wheels are also added in such a way that no untimely movements can occur whenever the clutches are disengaged. These functions are very familiar to anyone working in the trade. The locking action can be assured in a similar manner to that applied between hammer 64 and bolt 68. The action of zeroising hand 114 can easily be performed by an additional pushbutton arranged at 8 o'clock, controlling a hammer and a cam which forms part of the shaft supporting hand 114. Here again, the shaft supporting hand 114 can benefit from being friction-mounted to wheel 134.

This description has been produced with reference to two very different types of implementation, demonstrating two ways of enabling time worked in the course of normal week to be counted. It is very apparent however that numerous other solutions are possible which would still be covered by the frame of reference of this invention.

A rather interesting extension to this, in accordance with an implementation variant not illustrated here, it is possible to give the wearer of the watch a means of personally determining, a priori, the times during which the means of counting should operate. To this end, for example, cam 54 in FIG. 2 can be replaced with a composite mechanical structure of a kind which can be adjusted externally which makes it possible to modify at will the times during which the clutch is actuated.

The invention claimed is:

1. Watch comprising a case in which the following components are arranged:

a movement featuring a timing baseplate, a gear train driven by it and manual means of correction which can be applied to the gear train and means of displaying time comprising a dial and at least two hands driven by the gear train, moving across the dial to show hours and minutes, characterized in that said watch also comprises:

means of counting the passage of time, additional means of display comprising a counting hand, associated with the means of counting the passage of time to indicate a corresponding counted value and arranged to run through one cycle in one week, and a number of movable indexes associated with working days and arranged around an edge of the space over which said counting hand travels in order to form an adjustable counting scale, a clutch unit intended to activate the aforementioned means of counting by interconnecting these with the gear train.

2. Watch in accordance with claim 1, characterized in that the aforementioned gear train comprises:

a first moving part executing one revolution within a number of full weeks at least equal to one, and equipped with a first mechanical component which defines the days of the week during which the means of counting time should be activated and a second moving part executing one revolution every 24 hours and equipped with a second mechanical component which defines the times during which the means of counting time should be activated, whereby the aforementioned clutch unit is controlled by said first and second mechanical components to activate the aforementioned means of counting at the relevant days and times.

3. Watch in accordance with claim 2, characterized in that the aforementioned mechanical components are cams.

4. Watch in accordance with claim 2, characterized in that it also comprises manual means of control to act on the second mechanical component which determines the times during which the means of counting should be activated.

5. Watch in accordance with claim 1, characterized in that it also comprises manual means of control with the intended purpose of operating the clutch to enable the wearer of the watch to activate the means of counting time whenever it is deemed appropriate to do so.

6. Watch in accordance with claim 5, characterized in that the means of counting time comprise a moving part linked temporarily to the gear train by a clutch and whereby the additional means of display comprise an indicator of working time completed supported by the above moving part and whereby said manual means of display comprise first and second pushbuttons mounted on the case and arranged in such a way that they can interact with the aforementioned means of counting which are set up in such a way that successive presses of the first pushbutton control alternately start and stop the indicator of actual time worked, and where one press of the second pushbutton applied when the indicator of working time is stopped causes the system to reset to zero.

7. Watch in accordance with claim 6, characterized in that the aforementioned means of display also comprise:

an indicator of working time owed which can be controlled by the aforementioned means of correction and an indicator of reported time controlled by operation of the aforementioned second pushbutton and in that these means of counting time are arranged in such a way that one press of the second pushbutton performed when the indicator of working time is stopped causes the indicator for reported time to move across an arc (angle) equivalent to the difference between working time completed and working time owed, displayed respectively by the indicators of working time completed and working time owed.

8. Watch in accordance with claim 1, wherein said movable indexes are intended to mark positions at which said counting hand should stop at the end of a working day.

* * * * *